US006739369B2

(12) United States Patent
Watanabe

(10) Patent No.: US 6,739,369 B2
(45) Date of Patent: May 25, 2004

(54) COATING FILM TRANSFER TOOL

(75) Inventor: Kazuya Watanabe, Osaka (JP)

(73) Assignee: Fujicopian Co., Ltd., Osaka-fu (JP)

( * ) Notice: Subject to any disclaimer, the term of this patent is extended or adjusted under 35 U.S.C. 154(b) by 54 days.

(21) Appl. No.: 10/156,600

(22) Filed: May 28, 2002

(65) Prior Publication Data

US 2002/0195205 A1 Dec. 26, 2002

(30) Foreign Application Priority Data

Jun. 21, 2001 (JP) ..... 2001/187994

(51) Int. Cl.[7] ..... B32B 31/00

(52) U.S. Cl. ..... 156/577; 156/523; 156/579; 118/76; 242/160.4; 242/171; 242/588.6; 206/411

(58) Field of Search ..... 156/523, 527, 156/538, 540, 574, 577, 579; 118/76, 200, 257; 225/46; 242/160.2, 160.4, 170, 171, 588, 588.2, 588.3, 588.6

(56) References Cited

U.S. PATENT DOCUMENTS 6,273,982 B1 * 8/2001 Semmler ..... 156/238
6,499,524 B1 * 12/2002 Miller et al. ..... 156/577
6,601,631 B1 * 8/2003 Miller et al. ..... 156/577

FOREIGN PATENT DOCUMENTS

JP 5-502211 4/1993

* cited by examiner

*Primary Examiner*—Mark A. Osele
(74) *Attorney, Agent, or Firm*—Howson and Howson

(57) ABSTRACT

A small-sized coating film transfer tool is provided, in which a transfer head is capable of turning relative to a casing. A bearing hole extends widthwise through the main body of a transfer head, and an insertion member, provided at the end of the casing, is inserted into the bearing hole. In the assembly of the tool, the insertion member is inserted into the bearing hole of the transfer head, and, when the casing is united with its cover, an end of the insertion member is engaged with a part of the cover. The inside of the bearing hole of the transfer head comes into line contact with the insertion member, allowing the transfer head to turn smoothly relative to the casing about the contact location.

2 Claims, 4 Drawing Sheets

COATING FILM TRANSFER TOOL

FIELD OF THE INVENTION

This invention relates to a coating film transfer tool for transferring a film to a receiving surface. The film may be a coating film for correction, an adhesive, a decorative coating film, or the like.

BACKGROUND OF THE INVENTION

FIG. 6*a* shows a conventional coating film transfer tool 100 with its cover removed. This coating film transfer tool comprises a casing 200 having two reel support shafts 22*a* and 22*b*, a transfer head 300, which protrudes outwardly from an end of the casing and has a pressing transfer part 340 at its tip, a tape supply reel 24*b* and a take-up core 24*a*, which are rotatably mounted on the support shafts 22*a* and 22*b* respectively, and a transfer tape T comprising a base material tape coated with a coating film. The cover of the casing 200 is not shown.

A transfer tape T is initially wound on the supply reel 24*b*. As the tape T is unreeled from the supply reel 24*b*, it is separated into a coating film and a base material tape at the transfer part 340, and the coating film is transferred to a receiving surface. Only the base material tape is wound onto the take-up core 24*a*.

In the coating film transfer tool 100 of FIG. 6*a*, the take-up core 24*a* and the supply reel 24*b* are connected by an endless rubber belt B, which causes the take-up core and supply reel to rotate cooperatively.

A transfer head 300 comprises a main head body 320, having an elongated pressing part 340 extending across the width of the main head body 320 at its tip, and a cylinder-shaped support shaft 360. A bearing 260, which supports the support shaft 360 of the transfer head 300, is provided in the casing 200. FIG. 6(*b*) is a perspective view of the transfer head 300 and the bearing part 260 and FIG. 6(*c*) is a cross-sectional view taken on plane c—c of FIG. 6(*a*). As shown in FIG. 6(*b*), the support shaft 360 of the transfer head 300 is cylinder-shaped and is rotatably supported by the bearing 260.

By the above-described structure, even when the casing 200 is inclined while the coating film transfer tool 100 is being used, the transfer head 300 rotates in the direction shown by an arrow of FIG. 6(*c*) so that the entire length of the pressing transfer part 340 of the main body 320 of the head is pressed against a receiving surface. As a result, the coating film transfer tool 100 is capable of good transfer performance. However, because of the space needed to accommodate the bearing 260, the distance from the supply reel 2*b* to the opposite end of the casing inevitably becomes large, and the overall size of the coating film transfer tool 100 becomes large as a result.

Transfer tapes are continually being made thinner, and thinner tape base material films have weaker elasticity. When a transfer tape T having weak elasticity is used in a coating film transfer tool 100, in which the distance from the supply reel 24*b* to the transfer head at the opposite end of the casing is large, another problem arises. That problem is the ease with which twisting, meandering, or folding of the transfer tape T can occur between the supply reel and the transfer head at the opposite end of the casing.

In a coating film transfer tool disclosed in Unexamined PCT National Phase Publication No. 502211/1993, a transfer head is mounted to a casing by inserting a convex part provided in the casing into a concave part provided on the transfer head so that they are in sliding engagement with each other. By eliminating the support shaft and attaching the transfer head to the casing by inserting a convex part into a small concave part, the distance from the supply reel to the transfer head at the opposite end of the casing can be shortened, and the coating film transfer tool can be miniaturized. In this coating film transfer tool, when the casing is inclined while the tool is in use, the transfer head rotates by the sliding engagement of the concave and convex parts, and consequently the whole pressing surface of the transfer head is pressed against a receiving surface.

However, in case of the coating film transfer tool of Unexamined PCT National Phase Publication No. 502211/1993, if there is a breakage or distortion on the surfaces of the concave and convex parts, the transfer head becomes incapable of rotating smoothly. Therefore, the finish of the surfaces of the concave and convex parts requires close attention in the manufacturing process, which is time-consuming.

BRIEF SUMMARY OF THE INVENTION

The coating film transfer tool in accordance with the invention comprises a casing, a supply core and a take-up core, both disposed rotatably in the casing, a transfer head having a main body, a pressing part protruding from an end of the casing, and a transfer tape wound on the supply core. The transfer tape includes a tape base material which extends around the pressing part to the take-up core, and a transferable coating film which is separable from the tape base material, at the location of the pressing part, for transfer onto a receiving surface while the remaining tape base material is wound onto the take-up core. To this extent, the transfer tool in accordance with the invention is similar to a conventional coating film transfer tool. The coating film transfer tool in accordance with the invention departs from the conventional transfer tool in that it has a bearing hole in the main body of the transfer head, the bearing hole extending in a direction transverse to the direction in which the pressing part protrudes from the casing, and an insertion member extending into the bearing hole at the end of the casing from which the pressing part protrudes. The bearing hole is preferably tapered, having its smallest cross-section approximately at the center of the transfer head. In a most preferred embodiment, the bearing hole is a through hole through which the insertion member extends.

The transfer head is mounted in the casing by insertion of the insertion member into the bearing hole of the main body of the transfer head. The transfer head can be rotated relative to the casing while being supported by the insertion member. When the coating film transfer tool is inclined while being used, the transfer head rotates relative to the casing so that the entire pressing surface of the transfer part presses against a receiving surface, and effective transfer of the coating film is achieved. It is not necessary to provide extra space in the casing in order to mount the transfer head rotatably, as was the case in the past. Accordingly, the coating film transfer tool can be miniaturized.

BRIEF DESCRIPTION OF DRAWINGS

FIG. 1(*b*) is a perspective view of a transfer head used in FIG. 1(*a*);

FIG. 1(*c*) is a cross-sectional view taken on plane c—c of FIG. 1(*a*);

FIG. 3(*b*) is a cross-sectional view of a transfer head and an insertion member in a coating film transfer tool in accordance with a third embodiment of the invention;

FIG. 6(*b*) is an exploded perspective view of the transfer head of the transfer tool of FIG. 6(*a*); and FIG. 6(*c*) is a cross-sectional view taken on plane c—c of FIG. 6(*a*).

DETAILED DESCRIPTION OF THE PREFERRED EMBODIMENTS

Figure 1A:
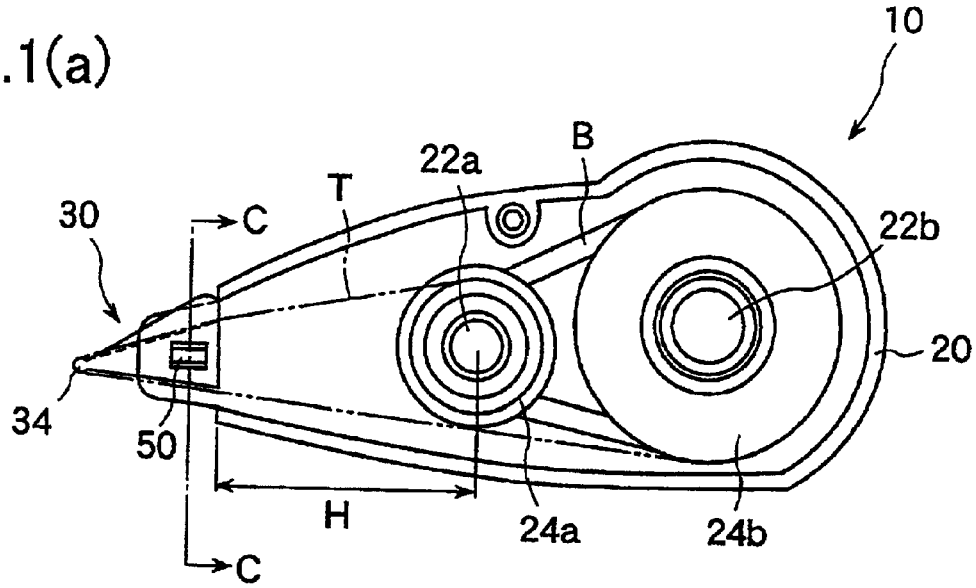
FIG. 1(*a*) is a top view of a coating film transfer tool of a first embodiment of the invention, with its cover removed.
Figure 1B:
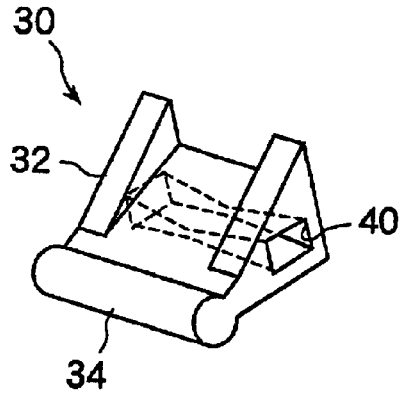
Figure 1C:
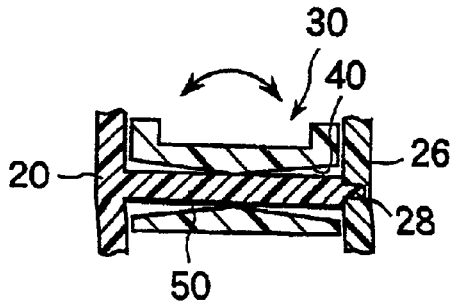

As shown in FIG. 1(*a*), a coating film transfer tool 10 according to the invention comprises a casing 20 having two support shafts 22*a* and 22*b*, a transfer head 30 which is provided at an end of the casing and has an elongated pressing part 34 at its end, extending across the width of the transfer head. The transfer tool 10 also has a supply core 24*b* and a take-up core 24*a*, which are rotatably mounted on the support shafts 22*a* and 22*b* respectively, and a transfer tape T comprising a base material tape coated with a coating film. The opening at the side of the casing 20 is closed by a cover (not shown). As in the past, the transfer tape T which is wound around the supply core 24*b* is unreeled and separated into a coating film and a base material tape at the pressing part 34, the coating film is transferred onto a receiving surface, and only the base material tape is reeled onto the take-up core 24*a*.

As shown in FIG. 1(*b*), the transfer head 30 comprises a main body 32, on an end of which the pressing part 34 is provided. A bearing hole 40, having a rectangular transverse cross-section, extends through the main body 32 of the transfer head 30. The distance between the upper and lower walls of the bearing hole 40 increases from a point midway along the length of the hole toward both ends, so that the bearing hole is tapered, with the area of the rectangular transverse cross section of the bearing hole 40 being smallest at the center of the main body 32, and gradually increasing toward both ends. At the end of the casing, a pillar shaped insertion member 50, having a uniform, rectangular, transverse cross-section, is fixed to, and extends perpendicularly from, the side of the casing 20. A recess 28, which receives a projection extending from the opposite end of the insertion member 50 is provided on the inside face of a cover 26 (see FIG. 1(*c*)).

With the insertion member 50 of the casing 20 extending through the bearing hole 40 of the transfer head 30, the transfer head 30 is securely mounted in the coating film transfer tool 10 by enclosing the casing 20 with the cover 26, inserting the projection at the end of the insertion member 50 into the recess 28 on the inside face of the cover 26. Since the upper and lower walls of the bearing hole 40 are formed so that the bearing hole is tapered with its transverse cross-section being smallest at the center of the main body 32 of the head and gradually increasing toward both ends (see FIG. 1(*b*)), the insertion member 50, which has a uniform cross section, comes into line contact with the upper and lower sides of the inside of the bearing hole 40 at the center of the transfer head 30. Therefore, the transfer head 30 is capable of turning in the direction of an arrow in FIG. 1(*c*) about the position where the insertion member 50 comes into line contact with the inside of the bearing hole 40.

Figure 2:
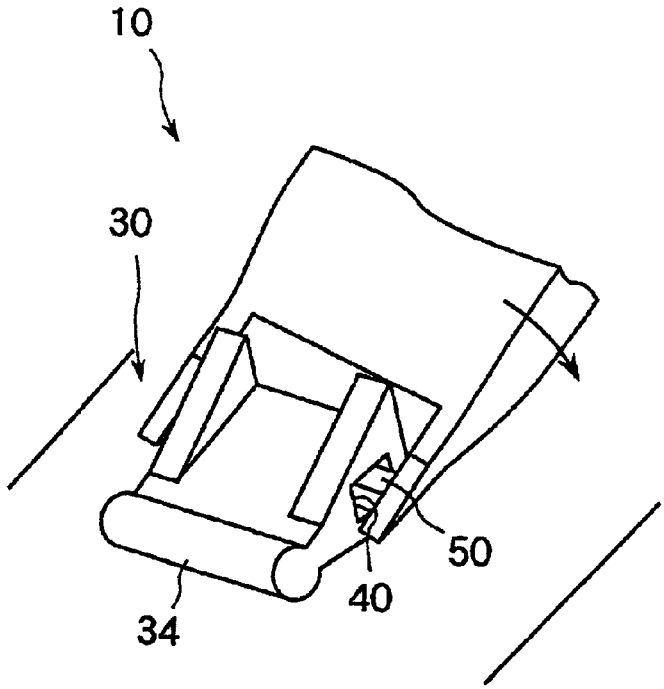
FIG. 2(*a*) and FIG. 2(*b*) are enlarged, partial perspective views which show coating film transfer tools in an inclined condition.
Figure 2:
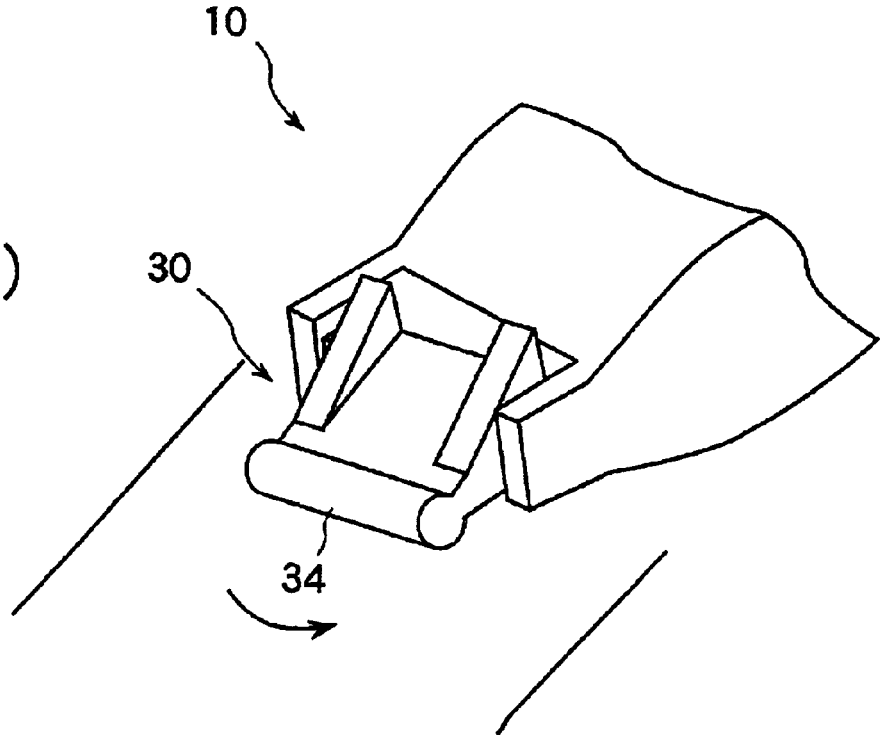

FIG. 2(*a*) shows the coating film transfer tool 10 inclined in the direction of an arrow, with the illustration of the transfer tape T omitted. As shown in FIG. 2(*a*), good transfer can be effected even when the coating film transfer tool 10 is inclined, because the transfer head 30 turns relative to the casing so that the entire length of the pressing part 34 can be pressed against a receiving surface.

Figure 3:
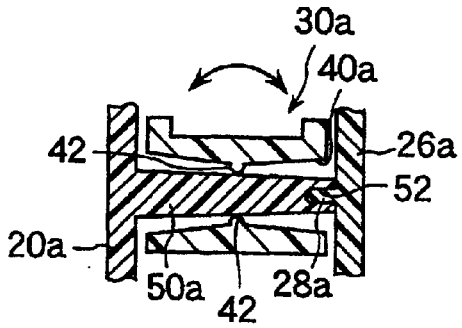
FIG. 3(*a*) is a cross-sectional view of a transfer head and an insertion member in a coating film transfer tool in accordance with a second embodiment of the invention.
Figure 3:
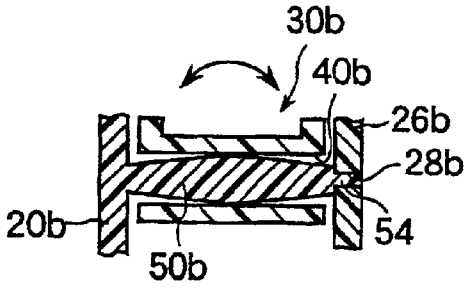

The bearing hole, of course, does not need to be smoothly tapered as in FIG. 1(*c*), and, with an appropriately shaped insertion member, the bearing hole need not be tapered at all. FIGS. 3(*a*) and 3(*b*) show the combination of a transfer head and an insertion member in coating film transfer tools of second and third embodiments of the invention. Each of these figures corresponds to a cross-sectional view taken on plane C—C of FIG. 1.

In the transfer head 30*a* of FIG. 3(*a*), the upper and the lower walls of the bearing hole 40*a* are tapered and have a rectangular transverse cross-section as in FIGS. 1(*b*) and 1(*c*). However, the upper and lower walls have projections 42 provided inside the bearing hole 40*a* at its center in the width direction. The insertion member 50*a* is tapered toward one end thereof. In this embodiment, a recess 52 is provided at the end of the insertion member 50*a*, and a complementary projection 28*a* is provided on the back of a cover 26*a*. As shown in FIG. 3(*a*), when the insertion member 50*a* extends through the bearing hole 40*a* of the transfer head 30*a*, the projections 42, which are provided on the upper and lower sides of the inside of the bearing hole 40*a*, come into point contact with the insertion member 50*a*.

In the third embodiment, illustrated in FIG. 3(*b*), A bearing hole 40*b*, having a uniform transverse cross-section is provided in a transfer head 30*b*. On the other hand, an insertion member 50*b* used in this embodiment is formed so that its central part is the thickest. In this embodiment, a hole 28*b* extends through a cover 26*b* and a casing 20*b* and the cover 26*b* are united by causing a projection 54 at the end of the insertion member 50*b* to engage with hole 28*b*. When the insertion member 50*b* extends through the bearing hole 40*b*, the insertion member 50*b* comes into line contact with the upper and lower sides of the inside of the bearing hole 40*b* at the center of the bearing hole.

In each case, the transfer head 30*a* or 30*b* is rotatable in the direction of the arrow of FIG. 3(*a*) or 3(*b*). As a result, good transfer can be achieved even when the coating film transfer tool is inclined in use. The transfer head 30*a* or 30*b* can turn (as if the transfer tool were shaking its head) so that the full length of the pressing part can be pressed against a receiving surface.

Figure 4:
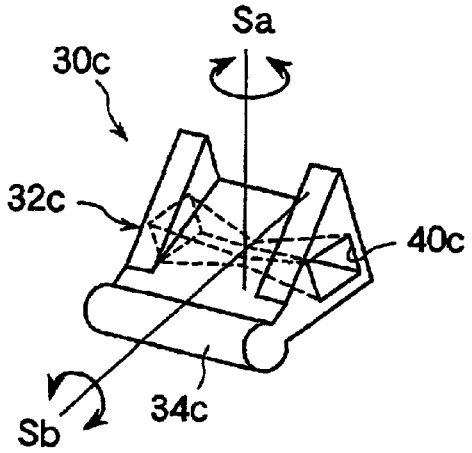
FIG. 4 is a perspective view of a transfer head of a coating film transfer tool in accordance with a fourth embodiment according to the invention.

In FIG. 4, the transfer head 30*c* in accordance with a fourth embodiment of the invention comprises a main head body 32*c* having a bearing hole 40*c*. The bearing hole has a rectangular transverse cross-section. All four sides (the upper, lower, right and left sides) of the bearing hole 40*c* taper toward the center of the bearing hole in the direction of the width of the transfer head. Thus, the transverse cross-section of the bearing hole 40*c* is smallest midway along the length of the hole, and gradually increases toward both ends. When an insertion member (not shown), also having a rectangular transverse cross-section, extends through the bearing hole 40*c*, the insertion member comes into line contact with the four walls of the bearing hole 40*c* at the location at which the transverse cross=section of the bearing hole 40*c* is the smallest. Therefore, the transfer head 30*c* is rotatable in the directions indicated by the arrows, about two axes, Sa and Sb, shown in FIG. 4, when installed in a coating film transfer tool. Thus, with this embodiment, it is possible for the transfer head 30 to turn (as if shaking its head) in a direction parallel to a receiving surface, as shown in FIG. 2(*b*).

Figure 5:
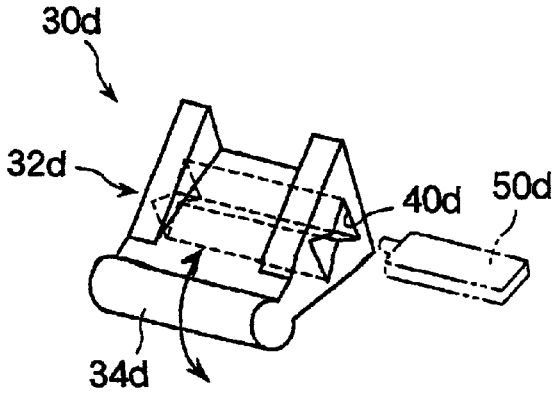
FIG. 5 is an exploded perspective view of a transfer head and an insertion member in a coating film transfer tool in accordance with a fifth embodiment of the invention.

In the fifth embodiment of the invention, as shown in FIG. 5, the main body 32*d* of a transfer head 30*d*, has a bearing hole 40*d* the transverse cross section of which is of uniform, bow-tie shape along the width of the main body 32*d*, being in the form of two intersecting triangles. The bearing hole extends parallel to the pressing part 34*d*.

When a rectangular, pillar-shaped, insertion member 50*d* extends through the bearing hole 40*d*, the bearing hole comes into line contact with the upper and lower sides of the insertion member 50*d*, allowing the transfer head 30*d* to rotate in the direction of the arrow of FIG. 5.

The coating film transfer tools of the second, third, fourth and fifth embodiments, are similar in operation to the transfer head of the first embodiment, except that the structure of the transfer heads 30*a*, 30*b*, 30*c* and 30*d* and/or the insertion member 50*a*, 50*b* and 50*d* differs from that of the corresponding parts in the first embodiment. In the coating film transfer tools of the alternative embodiments, since the transfer heads 30, 30*a*, 30*b*, 30*c* and 30*d* are mounted at the ends of the casings 20, 20*a* and 20*b* by insertion members 50, 50*a*, 50*b* and 50*d*, it is not necessary for extra space to be provided in the casings 20, 20*a* and 20*b* to accommodate the mounting of the transfer heads 30, 30*a*, 30*b*, 30*c* and 30*d*. As a result, the distance H, from the take-up core 24*a* to the end of the casing (see FIG. 1(*a*)) can be shortened and the coating film transfer tool as a whole can be miniaturized.

Moreover, the transfer heads 30, 30*a*, 30*b*, 30*c* and 30*d* may turned by a relatively small force, because the insides of the bearing holes 40, 40*a*, 40*b*, 40*c* and 40*d* come into line or point contact with the insertion members 50, 50*a*, 50*b* and 50*d*. As a result, good quality transfer can be accomplished, since the transfer heads 30, 30*a*, 30*b*, 30*c* and 30*d* respond to the inclination of the coating film transfer tool instantly, and turn smoothly, so that the entire lengths of the pressing parts, e.g. 34, 34*c* and 34*d*, and the corresponding pressing parts (not shown) of the embodiments of FIGS. 3(*a*) and 3(*b*), can be pressed against a receiving surface.

By engaging the insertion members 50, 50*a*, 50*b* and 50*d*, provided in the casings 20, 20*a* and 20*b*, with the engaging parts 28, 28*a* and 28*b* of the covers 26, 26*a* and 26*b*, the transfer heads 30, 30*a*, 30*b*, 30*c* and 30*d* are mounted in a simple manner, and the casings 20, 20*a* and 20*b* are united with their covers 26, 26*a* and 26*b*.

Figure 6A:
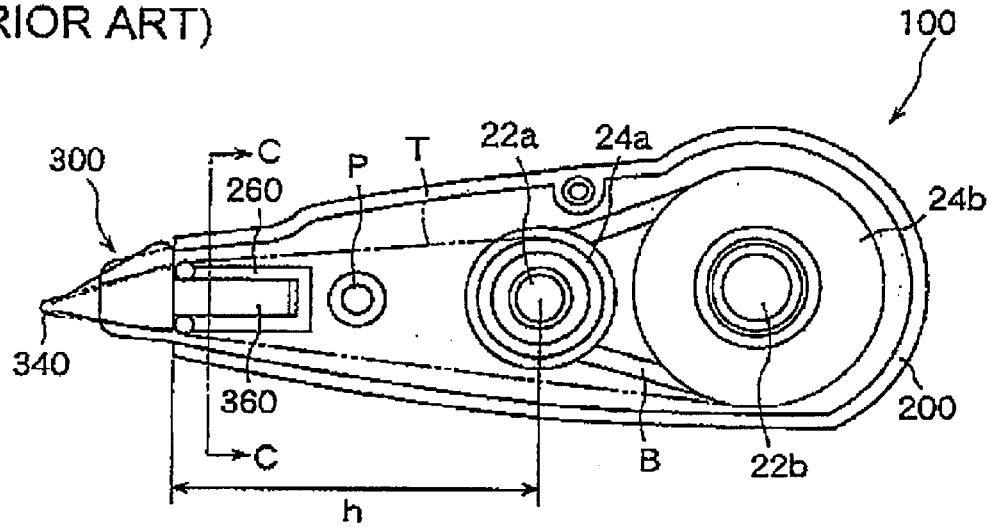
FIG.6(a) (PRIOR ART)
FIG. 6(*a*) is a top view of a conventional coating film transfer tool with its cover removed.
Figure 6B:
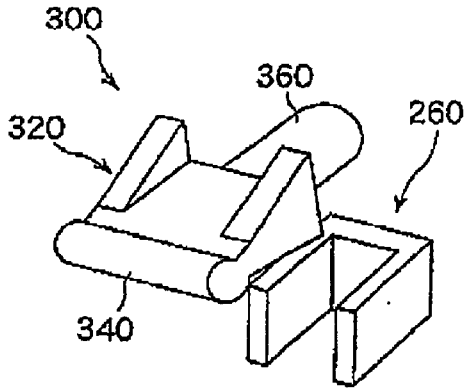
FIG.6(b) (PRIOR ART)
Figure 6C:
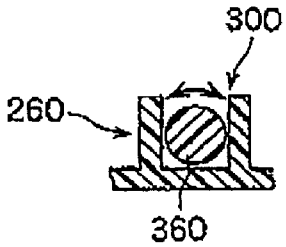
FIG.6(c) (PRIOR ART)

In a conventional coating film transfer tool, it is necessary to set up an insertion pin (for example pin P of FIG. 6) in the vicinity of a transfer head, to unite a casing with a cover. However, such an insertion pin does not need to be provided separately in the coating film transfer tool according to the invention.

In the above-described coating film transfer tool, it is acceptable for the insertion members 50, 50*a*, 50*b* and 50*d* to be molded as a unit with the casings 20, 20*a* and 20*b* or to mold them as separate bodies and later mounting them in the casings. If the insertion members are formed separately from the casings, the transfer head may be mounted in the coating film transfer tool and at the same time that the casing is united with the cover. This is achieved by providing one end of the insertion member in the casing, and inserting the other end into the cover.

In addition, an acceptable coating film transfer tool can be assembled, using an insertion member formed by a spring, or a plastics material which has flexibility, such as ABS (acrylonitrile butadiene styrene), PP (polypropylene) and PE (polyethylene), and so on. When the transfer head of the coating film transfer tool is pressed against a receiving surface, the transfer head is permitted to turn as a result of elastic deformation of the insertion member.

Although the bearing holes in the embodiments shown in the drawings extend through the main body of the transfer heads, the bearing hole and the insertion member do not necessarily need to extend entirely through the transfer head. For example, it an acceptable transfer tool can be formed with a cantilevered projection, inserted into a blind bearing hole.

Although not illustrated, both lateral sides of the transfer head may be made convex, for example spherically convex. When so shaped, the transfer head can turn easily even if the main body of the transfer head comes into contact with the side walls of the casing at the end from which the transfer head projects.

In the coating film transfer tool according to the invention, since the main body of the transfer head itself may be mounted rotatably in the casing, even when the coating film transfer tool is inclined while being used, the transfer head is capable of rotating, the entire length of the pressing part may be pressed against a receiving surface, and effective transfer of the coating film can be achieved. Since extra space is not necessary in the casing in order to mount the transfer head the coating film transfer tool may be miniaturized as a whole. Even when the base material of the transfer tape is a thin tape base material having relatively weak elasticity, twisting, meandering, and folding of the transfer tape is minimized.

What is claimed is:

1. A coating film transfer tool comprising a casing, a supply core and a take-up core, both disposed rotatably in the casing, a transfer head having a main body and a pressing part, the pressing part protruding in a first direction from an end of the casing, and a transfer tape wound on the supply core, wherein the transfer tape includes a tape base material which extends around the pressing part to the take-up core, a transferable coating film, which is separable from the tape base material at the location of the pressing part, for transfer onto a receiving surface while the remaining tape base material is wound onto the take-up core, and a bearing hole in said main body of the transfer head, the bearing hole extending in a second direction transverse to said first direction, and an insertion member extending into said bearing hole at said end of the casing, wherein the bearing hole is tapered, having its smallest cross-section approximately at the center of the transfer head.

2. A coating film transfer tool as claimed in claim 1, wherein said bearing hole is a through hole and said insertion member extends through said through hole.

* * * * *